US005518862A

United States Patent [19]

Okamura

[11] Patent Number: 5,518,862

[45] Date of Patent: May 21, 1996

[54] SILVER HALIDE PHOTOGRAPHIC MATERIAL

[75] Inventor: Hisashi Okamura, Kanagawa, Japan

[73] Assignee: Fuji Photo Film Co., Ltd., Kanagawa, Japan

[21] Appl. No.: 178,296

[22] PCT Filed: Dec. 9, 1993

[86] PCT No.: PCT/JP93/00770

§ 371 Date: Jan. 11, 1994

§ 102(e) Date: Jan. 11, 1994

[30] Foreign Application Priority Data

Jun. 10, 1992 [JP] Japan ..... 4-150692
Jun. 10, 1992 [JP] Japan ..... 4-150693

[51] Int. Cl.[6] ..... G03C 1/06

[52] U.S. Cl. ..... 430/264; 430/598

[58] Field of Search ..... 430/264, 598, 430/517

[56] References Cited

U.S. PATENT DOCUMENTS

| | | | |
|---|---|---|---|
| 4,767,692 | 8/1988 | Inagaki et al. | 430/264 |
| 4,798,780 | 1/1989 | Hall et al. | 430/264 |
| 5,155,015 | 10/1992 | Jimbo | 430/517 |

FOREIGN PATENT DOCUMENTS 0050758 3/1993 Japan .

*Primary Examiner*—Janet C. Baxter
*Attorney, Agent, or Firm*—Sughrue, Mion, Zinn, Macpeak & Seas

[57] ABSTRACT

The object of the present invention is to provide a silver halide light-sensitive material capable of forming a ultra high gradation image by processing in a stable developing solution.

The present invention is a silver halide photographic material containing at least one of the compounds represented by Formula (I) or (II):

Formula (I)

wherein X represents an aliphatic group, an aromatic group, or a heterocyclic group and may be substituted; $R_1$ represents a hydrogen atom, an alkyl group, an aryl group, an alkoxy group, an aryloxy group, or an amino group; $R_2$ and $R_3$ each represent an aliphatic group, an aromatic group, or a heterocyclic group and may be the same or different; and further $R_1$, $R_2$ and $R_3$ may be substituted and combined with each other to form a ring;

Formula (II)

wherein X represents an aliphatic group, an aromatic group, or a heterocyclic group and may be substituted; Y represents a —O— group, a —$NR_3$— group, a —S— group, a —SO— group, a —$SO_2$— group, or a —CO— group; $R_1$, $R_2$ and $R_3$ each represent an aliphatic group, an aromatic group, or a heterocyclic group and may be the same or different; and $R_1$ and $R_3$ may be a hydrogen atom; and further, $R_1$, $R_2$ and $R_3$ may be substituted and combined with each other to form a ring, and in the case where $R_1$ and $R_2$ are combined to form a ring, any one of them may be a single bond.

11 Claims, No Drawings

SILVER HALIDE PHOTOGRAPHIC MATERIAL

TECHNICAL FIELD

The present invention relates to a silver halide photographic material providing a negative image with a remarkably hard gradation, a high sensitive negative image, and a good dot image quality, or a silver halide photographic material for forming a direct positive photographic image, specifically to a photographic material containing a novel compound as a nucleus forming agent for silver halide.

TECHNICAL BACKGROUND

The addition of a hydrazine compound to a silver halide photographic emulsion or a developing solution is known in U.S. Pat. Nos. 3,730,727 (the developing solution in which ascorbic acid and hydrazine are combined), 3,227,552 (hydrazine is used as an auxiliary developing agent for obtaining a direct positive color image), 3,386,831 (β-monophenylhydrazide of aliphatic carboxylic acid is contained as a stabilizer for a silver halide light-sensitive material), and 2,419,975, and The Theory of Photographic Process written by Mees, the third edition (1966 ), p. 281.

Among them, it is disclosed particularly in U.S. Pat. No. 2,419,975 that a hydrazine compound is added to obtain a negative image with a hard gradation.

It is described in the same patent specification that the addition of the hydrazine compound to a silver bromochloride emulsion and a development in a developing solution having as high pH as 12.8 provide a very hard gradation photographic characteristic with gamma (γ) exceeding 10. However, the strong base developing solution having pH close to 13 is susceptible to an air oxidation and is instable. Accordingly, it can not endure storing and use for a long time.

An ultra high gradation photographic characteristic with gamma exceeding 10 is very useful for the photo-graphic reproduction of a continuous image with a dot image useful for a printing plate making or the reproduction of a line drawing either in a negative image or a positive image. There has so far generally been used for such the purpose, the method in which a silver bromochloride emulsion having a silver chloride content exceeding 50 mole% preferably 75 mole% is used to carry out a development in a hydroquinone developing solution having the effective concentration of a sulfurous acid ion set at a very low level (usually 0.1 mole/liter or less). However, because of the low sulfurous acid ion concentration in the developing solution in this method, the developing solution is very unstable and can not endure a storing exceeding three days.

Further, since these methods require to use the silver bromochloride emulsion having the relatively high silver chloride content, a high sensitivity has not been able to obtain. Accordingly, it has strongly been desired to use a high sensitive emulsion and a stable developing solution to obtain a ultrahard gradation photographic characteristic useful for the reproduction of a halftone dot image and a line drawing.

In U.S. Pat. Nos. 4,224,401, 4,168,977, 4,243,739, 4,272,614, and 4,323,643, the silver halide emulsions providing the very hard gradation negative photographic characteristics with a stable developing solution are disclosed. However, it has been known that the acylhydrazine compounds used therein have several defects.

That is, it is known that these conventional hydrazines generate a nitrogen gas during a development processing, and these gases are concentrated in a film to form bubbles and damage a photographic image. Further, they are eluted in a development processing solution to exert an adverse affect to a photographic material.

It has so far been known as the means for preventing the elution to the development processing solution to increase the molecular weight of a nucleus forming agent to provide it with an anti-diffusion character. However, it has come to be known that the problem on an aging stability is involved in a conventional anti-diffusible nucleus forming agent. That is, the aging of a coating solution containing the nucleus forming agent generates a deposit in the coating solution to deteriorate a filtering performance and further changes the photographic performances.

In the case where a lot of these conventional hydrazines is required for a sensitization and a hard gradation and a particularly high sensitivity is required to the performances of a light-sensitive material, the combined use with the other sensitizing techniques (for example, enhancing a chemical sensitization, increasing a grain size, and adding the compounds accelerating a sensitization as described in U.S. Pat. Nos. 4,272,606, and 4,241,164) generally causes an aging sensitization and the increase in a fog during a storage in some cases.

Accordingly, there have been desired the compounds which can reduce the generation of bubbles and the elution to a developing solution, have no problems on an aging stability, and provide a very hard gradation photographic characteristic with the addition of a very small amount.

Further, it is described in U.S. Pat. Nos. 4,385,108, 4,269,929, and 4,243,739 that hydrazines having a substituent easily adsorbing on a silver halide grain can be used to obtain a photographic performance with a very hard negative gradation. However, those concretely described in the above exemplified compounds among the hydrazine compounds having an adsorbing group have the problem that they cause an aging desensitization during a storage. Accordingly, it was required to select the compounds causing no such the problem.

Meanwhile, the direct positive photographic processes are variously available, and most useful are the process in which the silver halide grains fogged in advance are exposed under the presence of a desensitizer and then developed, and the process in which the silver halide emulsion having a light-sensitive nucleus mainly in the inside of a silver halide grain is exposed and then developed under the presence of a nucleus forming agent. The present invention relates to the latter. The silver halide emulsion which has the light-sensitive nucleus mainly in the inside of the silver halide grain and in which a latent image is formed mainly in the inside of the grain is called an inner latent image type silver halide emulsion, and it can be distinguished from the silver halide grains forming the latent image mainly on a grain surface.

There are known the process in which the internal latent image type silver halide photographic emulsion is subjected to a surface development under the presence of a nucleus forming agent to obtain a direct positive image, and the photographic emulsions or light-sensitive materials used for such the process.

In the above method for obtaining the direct positive image, the nucleus forming agent may be added to a developing solution. A better reversal characteristic can be obtained when it is added to the photographic emulsion layer or other suitable layers of a light-sensitive material to adsorb it on a silver halide grain surface.

There are known as the nucleus forming agent used for the above method for obtaining the direct positive image, hydrazines described in U.S. Pat. Nos. 2,563,785 and 2,588,982; the hydrazine and hydrazide series compounds described in U.S. Pat. No. 3,227,552; the heterocyclic quaternary salt compounds described in U.S. Pat. Nos. 3,615,615, 3,719,494, 3,734,738, 4,094,683, and 4,115,122, British Patent 1,283,835, and JP-A-52-3426 (the term "JP-A" as used herein means an unexamined published Japanese patent application) and 52-69613; the thiourea combining type acylphenylhydrazine series compounds described in U.S. Pat. Nos. 4,030,925, 4,031,127, 4,139,387, 4,245,037, 4,255,511, and 4,276,364, and British Patent 4,012,443; the compounds having heterocyclic thioamide as an adsorbing group, described in U.S. Pat. No. 4,080,207; the phenylacylhydrazine compounds having a heterocyclic group having a mercapto group as an adsorbing group, described in British Patent 2,011,397B; the sensitizing dyes having a substituent having a nucleus forming action in a molecular structure, described in U.S. Pat. No. 3,718,470; and the hydrazine compounds described in JP-A-59-200230, JP-A-50-212828, and JP-A-59-212829, and *Research Disclosure* No. 23510 (November 1953).

However, it has come to be found that there are involved therein the defects that any of these compounds have an insufficient activity as the nucleus forming agent and those having a high activity have an insufficient storing performance and that after they are added to an emulsion, the activities thereof are changed before coating and further the addition of a lot thereof deteriorates a membrane quality.

There are proposed for the purpose of solving these defects, the adsorptive type hydrazine derivatives described in JP-A-60-179743, JP-A-61-170733, JP-A-62-65034, JP-A-62-948, and JP-A-61-270744; the hydrazine derivatives having a heteroaromatic ring residue in a molecule, described in JP-A-62-275247; or the hydrazine derivatives having a group for a modification, described in JP-A-62-270948 and JP-A-63-29751. However, there used to be involved therein the problems that any of them has an insufficient nucleus forming activity for the requirements to lower pH of a development processing solution in order to increase the stability of the processing solution (that is, to prevent the deterioration of a developing agent), to shorten a processing time in a development, or to decrease a dependency on the fluctuation of a developing solution composition (for example, pH and sodium sulfite) and that an adverse influence due to the elution to the development processing solution can be seen.

Accordingly, a first object of the present invention is to provide a silver halide photographic material capable of providing a very hard gradation photographic characteristic having a gamma exceeding 10 in a stable developing solution.

A second object of the present invention is to provide a negative type silver halide photographic material containing high activity hydrazines capable of providing a desired very hard gradation photographic characteristic even in a low pH developing solution at a small addition amount without exerting an adverse influence to the photographic performances.

A third object of the present invention is to provide a direct positive type silver halide photographic material containing high activity hydrazines capable of providing an excellent reversal characteristic even in the low pH developing solution.

A fourth object of the present invention is to provide a silver halide photographic material containing hydrazines which can easily be synthesized and have an excellent storing performance and having a good aging stability.

A fifth object of the present invention is to provide a silver halide photographic material in which an emulsion has a good aging stability and an activity fluctuation in manufacturing the light-sensitive material is small.

DISCLOSURE OF THE INVENTION

These objects of the present invention have been achieved by a silver halide photographic material having at least one silver halide photographic emulsion layer, wherein the above photographic emulsion layer or the other at least one hydrophilic colloid layer contains at least one of the compounds represented by the following Formula (I) or Formula (II):

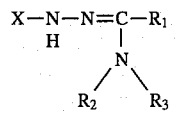

Formula (I)

wherein X represents an aliphatic group, an aromatic group, or a heterocyclic group and may be substituted; $R_1$ represents a hydrogen atom, an alkyl group, an aryl group, an alkoxy group, an aryloxy group, or an amino group; $R_2$ and $R_3$ each represents an aliphatic group, an aromatic group, or a heterocyclic group and may be the same or different; and further $R_1$, $R_2$ and $R_3$ may be substituted and combined with each other to form a ring;

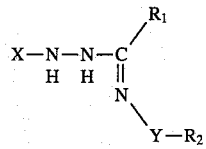

Formula (II)

wherein X represents an aliphatic group, an aromatic group, or a heterocyclic group and may be substituted; Y represents a —O— group, a —$NR_3$— group, a —S— group, a —SO— group, a —$SO_2$— group, or a —CO— group; $R_1$, $R_2$ and $R_3$ each represents an aliphatic group, an aromatic group, or a heterocyclic group and may be the same or different; and $R_1$ and $R_3$ may be a hydrogen atom; and further, $R_1$, $R_2$ and $R_3$ may be substituted and combined with each other to form a ring, and in the case where $R_1$ and $R_2$ are combined to form a ring, either one of them may be a single bond.

The present invention will be explained below in detail. First, Formula (I) will be explained in detail.

In Formula (I), the aliphatic group represented by X is a linear, branched or cyclic alkyl group, an alkenyl group or an alkynyl group. The aromatic group represented by X is a monocyclic or dicyclic aryl group and there can be enumerated, for example, a phenyl group and a naphthyl group.

The heterocyclic group represented by X is a 3- to 10-membered saturated or unsaturated heterocyclic group containing at least one of N, O or S atom, and these may be a single ring or further form a condensed ring with other aromatic rings or heterocycles. The heterocyclic group is preferably a 5- to 6-membered aromatic heterocyclic group, and preferred are those including a pyridyl group, an imidazolyl group, a quinolinyl group, a benzimidazolyl group, a pyrimidyl group, a pyrazolyl group, an isoquinolinyl group, a thiazolyl group, and a benzothiazolyl group.

An aromatic group and a nitrogen-containing heterocyclic group are preferred as X, and the aromatic group is more preferred as X. An aryl group is particularly preferred.

X may be substituted with a substituent. There can be enumerated as the example of the substituent, for example, an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, an alkoxycarbonyl group, an acyloxy group, a carbonamide group, a sulfonamide group, a nitro group, an alkylthio group, and a arylthio group, and in addition thereto, the group represented by the following Formula (A):

$$R_4-L-Z-\underset{\underset{R_5}{|}}{N}- \qquad \text{Formula (A)}$$

wherein Z represents —CO—, —$SO_2$—, or —P(=O)($R_6$)—(in which $R_6$ represents an alkoxy group or an aryloxy group); L represents a single bond, —O—, —S—, or —$NR_7$—(in which $R_7$ represents a hydrogen atom, an aliphatic group, or an aromatic group); and $R_4$ and $R_5$ each represents a hydrogen atom, an aliphatic group, an aromatic group, or a heterocyclic group and may be the same or different, or may be combined with each other to form a ring.

Further, X can contain one or a plurality of Formula (A).

In Formula (A), the aliphatic group represented by $R_4$ is a linear, branched or cyclic alkyl group, an alkenyl group, or an alkynyl group. The aromatic group represented by $R_4$ is a monocyclic or dicyclic aryl group and there can be enumerated, for example, a phenyl group and a naphthyl group.

The heterocyclic group represented by $R_4$ is a 3- to 10-membered saturated or unsaturated heterocyclic group containing at least one of an N, O or S atom, and these may be a single ring or may further form a condensed ring with the other aromatic or hetero rings. The heterocyclic group is preferably a 5- to 6-membered aromatic heterocyclic group, and preferred are those including, for example, a pyridyl group, an imidazolyl group, a quinolinyl group, a benzimidazolyl group, a pyrimidyl group, a pyrazolyl group, an isoquinolinyl group, a thiazolyl group, and a benzothiazolyl group.

$R_4$ may be substituted with a substituent. For example, the following ones can be enumerated as the substituent. These groups may further be substituted.

They are, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, a alkoxycarbonyl group, an acyloxy group, a carbonamide group, a sulfonamide group, a nitro group, an alkylthio group, and an arylthio group. These groups may be combined with each other to form a ring if possible.

The aliphatic group represented by $R_5$ in Formula (A) is a linear, branched or cyclic alkyl group, an alkenyl group, or an alkynyl group. The aromatic group represented by $R_5$ is a monocyclic or dicyclic aryl group, and for example, a phenyl group can be enumerated. $R_5$ may be substituted with a substituent. For example, those enumerated as the substituent for $R_4$in Formula (A) can be enumerated as the substituent therefor.

Further, $R_4$ and $R_5$ may be combined with each other to form a ring if possible. A hydrogen atom is more preferred as $R_5$.

Particularly preferred as Z in Formula (A) are —CO— and —$SO_2$—, and L is preferably a single bond or —$NR_7$—.

The aliphatic group represented by $R_7$ in Formula (A) is a linear, branched or cyclic alkyl group, an alkenyl group, or an alkynyl group. The aromatic group represented by $R_7$ is a monocyclic or dicyclic aryl group, and for example, a phenyl group is enumerated. $R_7$ may be substituted with a substituent. There can be enumerated as the substituent, for example, those enumerated as the substituent for $R_4$ in Formula (A). A hydrogen atom is more preferred as $R_7$.

In Formula (I), $R_1$ represents a hydrogen atom, an alkyl group, an aryl group, an alkoxy group, an aryloxy group, or an amino group. An alkyl group and an alkoxy group may be any of linear, branched and cyclic ones. $R_1$ may be substituted, and those enumerated as the substituent for $R_4$ in Formula (A) can be applied as the example of the preferred substituent. $R_1$ is preferably an amino group and particularly preferred is the substituted amino group. When the $R_1$ represents the substituted amino group, the nitrogen atom may form a nitrogen-containing heterocycle may be combined with $R_2$ and/or $R_3$ to form a cyclic structure.

The aliphatic group represented by $R_2$ and $R_3$ in Formula (I) is a linear, branched or cyclic alkyl group, an alkenyl group, or an alkynyl group. The aromatic group represented by $R_2$ and $R_3$ is a monocyclic or dicyclic aryl group and for example, a phenyl group can be enumerated. A furan group, a thiophene group, and a pyridine group can be enumerated as the heterocyclic group represented by $R_2$ and $R_3$. $R_2$ and $R_3$ may be substituted with a substituent. For example, those enumerated as the substituent for $R_4$ in Formula (A) can be enumerated as the substituent therefor. $R_2$ and $R_3$ may be combined with each other to form a ring if possible.

In Formula (I), X and one or a plurality of $R_1$, $R_2$ and $R_3$ may have an adsorption accelerating group to silver halide.

The adsorption accelerating group to silver halide, which can be substituted on $R_1$, $R_2$, $R_3$, or X can be represented by the following Formula (C):

$$Z'-(L')_t- \qquad \text{Formula (C)}$$

In Formula (C), Z' is the portion adsorbing on a silver halide surface, and L is a divalent linkage group. t is 0 or 1.

There can be enumerated as the preferred example of the portion adsorbing on the silver halide surface represented by Z', a thioamide group, a mercapto group, a group having a disulfide group, or a 5- to 6-membered nitrogen-containing heterocyclic group.

The thioamide group represented by Z' is a divalent group represented by —CS—(amino)— and may be a part of a ring structure or an acyclic thioamide group. The useful thioamide group can be selected from those disclosed in, for example, U.S. Pat. Nos. 4,030,925, 4,031,127, 4,080,207, 4,245,037, 4,255,511, 4,266,013, and 4,276,364, and *Research Disclosure* vol. 151, No. 15162 (November 1976 ) and vol. 176, No. 17626 (December 1978).

There can be enumerated as the concrete example of the acyclic thioamide group, for example, a thioureido group, a thiourethane group, and a dithiocarbamic acid ester group, and as the concrete example of a cyclic thioamide group, for example, 4-thiazolin-2-thione, 4-imidazolin-2-thione, 2-thiohydantoin, rhodanine, thiobarbituric acid, tetrazolin-5-thione, 1,2,4-triazolin-3-thione, 1,3,4-thiadiazolin-2-thione, 1,3,4-oxadiazolin-2-thione, benzimidazolin-2-thione, benzoxazolin-2-thione, and benzothiazolin-2-thione. These may further be substituted.

There can be enumerated as the mercapto group represented by Z', an aliphatic mercapto group, an aromatic mercapto group, and a heterocyclic mercapto group (in the case where a nitrogen atom is present next to the carbon atom to which a —SH group is bonded, the same as a cyclic thioamide group having the relationship of a tautomer therewith and the concrete examples of this group are the same as those enumerated above).

There can be enumerated as the 5- to 6-membered nitrogen-containing heterocyclic group represented by Z', a 5- to 6-membered nitrogen-containing heterocyclic group consisting of the combination of nitrogen, oxygen, sulfur, and carbon. Of them, there can be enumerated as the preferred one, a benzotriazole, a triazole, a tetrazole, an indazole, a benzimidazole, an imidazole, a benzothiazole, a thiazole, a benzoxazole, an oxazole, a thidiazole, an oxadiazle, and a triazine.

These may further be substituted with a suitable substituent. The substituents described as the substituents for X can be enumerated as the substituents therefor.

Of those represented by Z', a preferred one is a cyclic thioamide group (that is, a mercapto-substituted nitrogen-containing heterocycle, for example, a 2-mercaptothiadiazole group, 3-mercapto-1, 2,4-triazole group, a 5-mercaptotetrazole group, a 2-mercapto-1,3,4-oxadiazole group, and 2-mercaptobenzoxazole group), or a nitrogen-containing heterocyclic group (for example, a benzotriazole group, a benzimidazole group, and an indazole group).

The divalent linkage group represented by L' is an atom or atomic group containing at least one of C, N, S, and O. To be concrete, it is singly, for example, an alkylene group, an alkenylene group, an alkynylene group, an arylene group, —O—, —S—, —NH—,—N=, —CO—, or —$SO_2$—, or the combination thereof.

There can be enumerated as the concrete example, for example, $-CONH-$, $-NHCONH-$, $-SO_2NH-$, $-COO-$, $-NHCOO-$, $-NHCONHCH_2CH_2CONH-$, $-CH_2CH_2SO_2NH-$, $-CH_2CH_2CONH-$, $-CH_2-$, $-(CH_2)_2-$, $-(CH_2)_3-$,

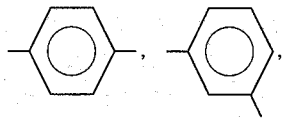

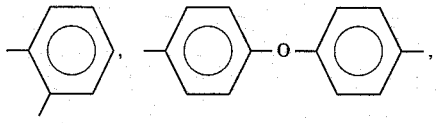

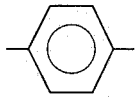

$-CONHCH_2CH_2-$,

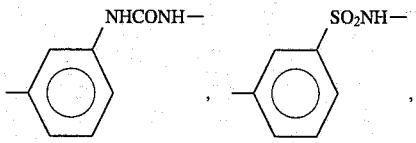

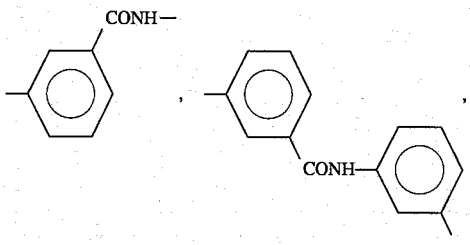

-continued

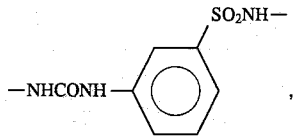

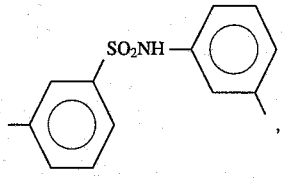

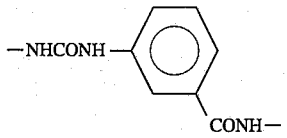

These may further be substituted with a suitable substituent. Those described as the substituents for X can be enumerated as the substituents therefor. Two or more adsorption accelerating groups to silver halide represented by Formula (C) may be substituted on any one of X, $R_1$, $R_2$, and $R_3$ and may be the same or different.

In the case where the compound of the present invention has the adsorption accelerating group to silver halide represented by above Formula (C), it is preferred as well since there is not involved the problem that it brings about an aging desensitization.

Further, X or $R_1$ to $R_3$ may contain therein a ballast group conventionally used in the immobile photographic additives such as a coupler.

The ballast group is an organic group providing a molecular weight sufficient to make it impossible to allow the compound represented by Formula (I) to substantially be diffused to the other layers or a processing solution and consists of the combination of one or more of an alkyl group, an aryl group, a heterocyclic group, an ether group, a thioether group, an amide group, a ureido group, a urethane group, and a sulfonamide group. More preferred as the ballast group is a ballast group having a substituted benzene ring, and the ballast group having the benzene ring substituted with a branched alkyl group is particularly preferred.

In the case where the compound of the present invention has the above ballast group, it is preferred as well since it provides an excellent aging stability to an emulsion and there is not involved the problem that it generates a deposit in a coating solution to deteriorate a filtering performance.

The concrete examples of the compound represented by Formula (I) will be shown below but the present invention will not be limited to the following compounds.

Compound I-1
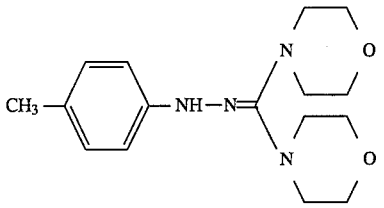
Compound I-2
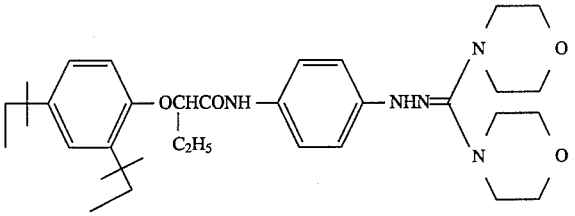
Compound I-3
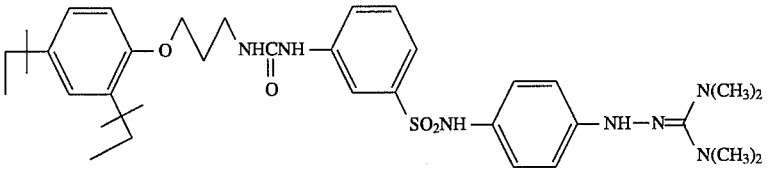
Compound I-4
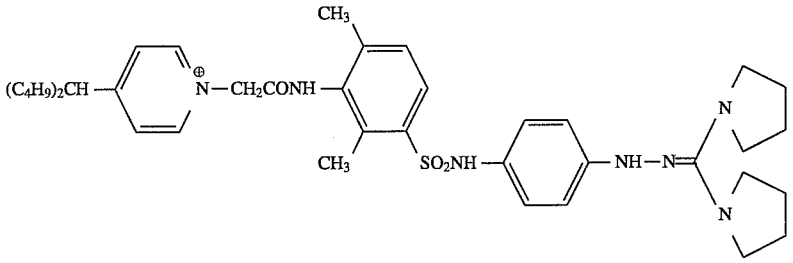
Compound I-5
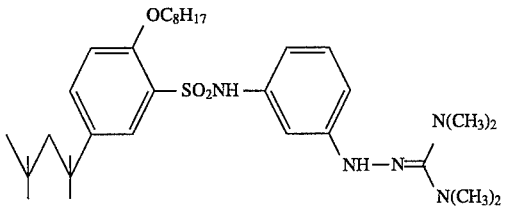
Compound I-6
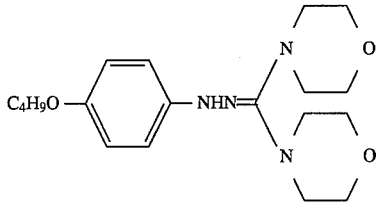

-continued
Compound I-7
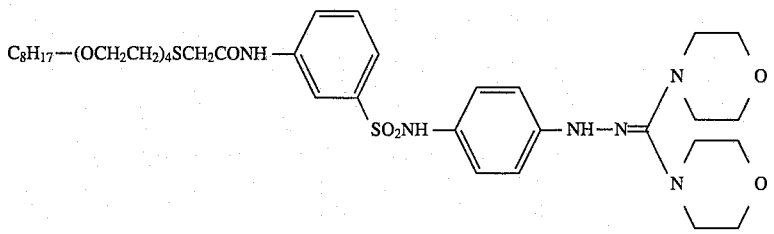
Compound I-8
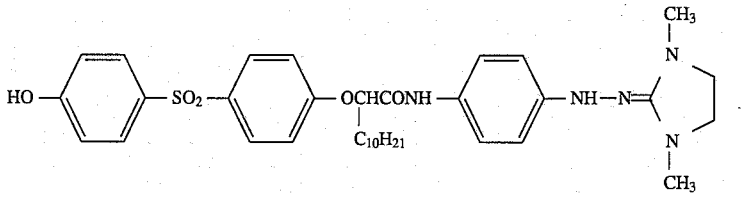
Compound I-9
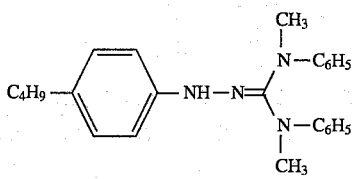
Compound I-10
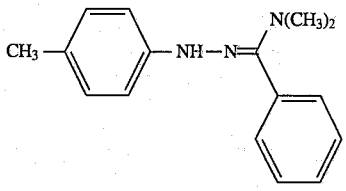
Compound I-11
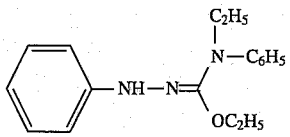
Compound I-12
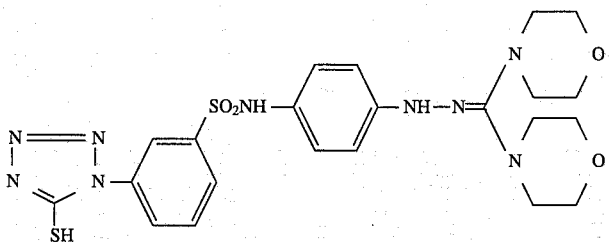
Compound I-13
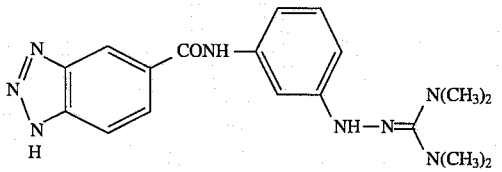

-continued

Compound I-14

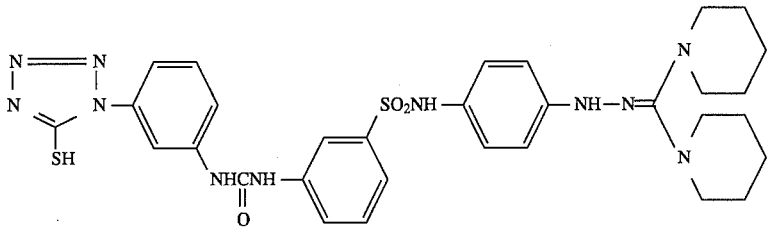

Compound I-15

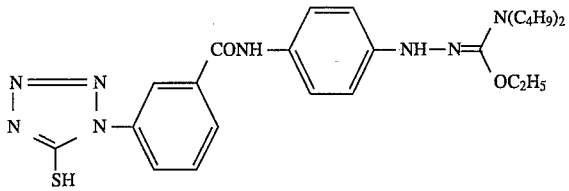

Next, Formula (II) will be explained in detail.

The compound of the present invention represented by Formula (II) is present in the form of the compound of the following Formula (II') or expressed thereby in some occasions. The presence in the form either of Formula (II) or Formula (II') remains similarly useful for the present invention. In the following description, the form of Formula (II) will be represented and described but the same will be applied even in the form of Formula (II').

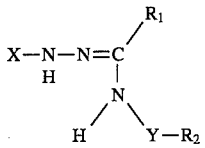

Formula (II')

In Formula (II'), all of X, Y, $R_1$, and $R_2$ are synonymous with Formula (II).

In Formula (II), the aliphatic group represented by X is a linear, branched or cyclic alkyl group, an alkenyl group or an alkynyl group. The aromatic group represented by X is a monocyclic or dicyclic aryl group and there can be enumerated, for example, a phenyl group and a naphthyl group.

The heterocyclic group represented by X is a 3- to 10-membered saturated or unsaturated heterocyclic group containing at least one of an N, O or S atom, and these may be a single ring or further form a condensed ring with the other aromatic rings or heterocycles. The heterocyclic group is preferably a 5- to 6-membered aromatic heterocyclic group, and preferred are those including a pyridyl group, an imidazolyl group, a quinolinyl group, a benzimidazolyl group, a pyrimidyl group, a pyrazolyl group, an isoquinolinyl group, a thiazolyl group, and a benzothiazolyl group.

An aromatic group and a nitrogen-containing heterocyclic group are preferred as X and the aromatic group is more preferred as X. An aryl group is particularly preferred.

X may be substituted with a substituent. There can be enumerated as the example of the substituent, for example, an alkyl group, an aralkyl group, an alkenyl group, an alkynyl group, an alkoxy group, an aryl group, a substituted amino group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, an alkoxycarbonyl group, an acyloxy group, a carbonamide group, a sulfonamide group, a nitro group, an alkylthio group, and a arylthio group, and in addition thereto, the group represented by the following Formula (B):

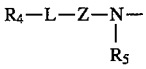

Formula (B)

In Formula (B), Z represents —CO—, —$SO_2$—, or —P(=O)($R_6$)—(in which $R_6$represents an alkoxy group or an aryloxy group); L represents a single bond, —O—, —S—, or —$NR_7$— (in which $R_7$ represents a hydrogen atom, an aliphatic group, or an aromatic group); and $R_4$ and $R_5$ each represents a hydrogen atom, an aliphatic group, an aromatic group, or a heterocyclic group and may be the same or different, or may be combined with each other to form a ring.

Further, X can contain one or a plurality of Formula (B).

In Formula (B), the aliphatic group represented by $R_4$ is a linear, branched or cyclic alkyl group, an alkenyl group, or an alkynyl group. The aromatic group represented by $R_4$ is a monocyclic or dicyclic aryl group and there can be enumerated, for example, a phenyl group and a naphthyl group.

The heterocyclic group represented by $R_4$ is a 3- to 10-membered saturated or unsaturated heterocyclic group containing at least one of an N, O or S atom, and these may be a single ring or may further form a condensed ring with other aromatic or heterocycles. The heterocyclic group is preferably a 5- to 6-membered aromatic heterocyclic group, and preferred are those including, for example, a pyridyl group, an imidazolyl group, a quinolinyl group, a benzimidazolyl group, a pyrimidyl group, a pyrazolyl group, an isoquinolinyl group, a thiazolyl group, and a benzothiazolyl group.

$R_4$ may be substituted with a substituent. For example, the following ones can be enumerated as the substituent. These groups may further be substituted.

They are, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an alkyl- and aryloxycarbonyl group, an acyl group, a alkoxycarbonyl group, an acyloxy group, a carbonamide group, a sulfonamide group, a nitro group, an alkylthio group, and an arylthio group. These groups may be combined with each other to form a ring if possible.

The aliphatic group represented by $R_5$ in Formula (B) is a linear, branched or cyclic alkyl group, alkenyl group, or alkynyl group. The aromatic group represented by $R_5$ is a monocyclic or dicyclic aryl group, and for example, a phenyl group can be enumerated. $R_5$ may be substituted with a substituent. For example, those enumerated as the substituent for $R_4$ in Formula (A) can be enumerated as the substituent therefor.

Further, $R_4$ and $R_5$ may be combined with each other to form a ring if possible. A hydrogen atom is more preferred as $R_5$.

Particularly preferred as Z in Formula (B) are —CO— and —$SO_2$—, and L is preferably a single bond or —$NR_7$—.

The aliphatic group represented by $R_7$ in Formula (B) is a linear, branched or cyclic alkyl group, alkenyl group, or alkynyl group. The aromatic group represented by $R_7$ is a monocyclic or dicyclic aryl group, and for example, a phenyl group can be enumerated. $R_7$ may be substituted with a substituent. There can be enumerated as the substituent, for example, those enumerated as the substituent for $R_4$ in Formula (B). A hydrogen atom is more preferred as $R_7$.

Preferred as Y in Formula (II) are a —O— group, a —$SO_2$— group, and a —CO— group, and a —$SO_2$— group and a —CO— group are particularly preferred.

The aliphatic group represented by $R_1$, $R_2$ and $R_3$in Formula (II) is a linear, branched or cyclic alkyl group, alkenyl group, or alkynyl group. The aromatic group represented by $R_1$, $R_2$ and $R_3$ is a monocyclic or dicyclic aryl group and for example, a phenyl group can be enumerated. A furan ring, a thiophene ring, and a pyridine ring can be enumerated as the heterocyclic group represented by $R_2$ and $R_3$. Further, $R_1$ and $R_3$ may be a hydrogen atom. $R_1$, $R_2$ and $R_3$ may be substituted with a substituent. For example, those enumerated as the substituent for $R_4$ in Formula (B) can be enumerated as the substituent therefor. Further, $R_1$, $R_2$ and $R_3$ may be combined with each other to form a ring if possible. In the case where $R_1$ and $R_2$ is combined to form a ring, either one of $R_1$ and $R_2$ may be a single bond.

In Formula (II), X and either one or a plurality of $R_1$ and $R_2$ may have an adsorption accelerating group to silver halide.

The adsorption accelerating group to silver halide, which can be substituted on $R_1$, $R_2$, or X can be represented by the following Formula (C'):

$$Z'-(L')_t- \qquad \text{Formula (C')}$$

In Formula (C'), all of Z', L', and t are synonymous with those in Formula (C). Accordingly, with respect to the portion adsorbing on a silver halide surface represented by Z', the divalent linkage group represented by L', and t, those in Formula (C) can be applied as well to Formula (C') as the preferred examples and concrete examples thereof.

In the case where the compound of the present invention has the adsorption accelerating group to silver halide represented by above Formula (C'), it is preferred as well since there is not involved the problem that it brings about an aging desensitization.

In Formula (II), X or $R_1$ and $R_2$ may contain therein a ballast group conventionally used in the immobile photographic additives such as a coupler.

The ballast group is an organic group providing a molecular weight sufficient to make it impossible to allow the compound represented by Formula (II) to substantially be diffused to the other layers or a processing solution and consists of the combination of one or more of an alkyl group, an aryl group, a heterocyclic group, an ether group, a thioether group, an amide group, a ureido group, a urethane group, and a sulfonamide group. More preferred as the ballast group is a ballast group having a substituted benzene ring, and the ballast group having the benzene ring substituted with a branched alkyl group is particularly preferred.

In the case where the compound of the present invention has the above ballast group, it is preferred as well since it provides an excellent aging stability to an emulsion and there is not involved the problem that it generates a deposit in a coating solution to deteriorate a filtering performance.

The concrete examples of the compound represented by Formula (II) will be shown below but the present invention will not be limited to the following compounds. Further, any of them will contain the case in which it is present in the form of Formula (II').

Compound II-1

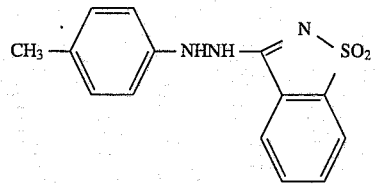

Compound II-2

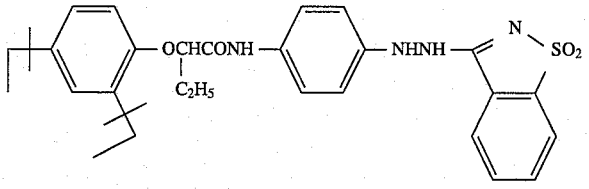

-continued
Compound II-3
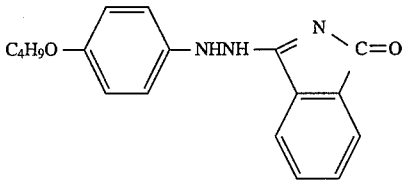
Compound II-4
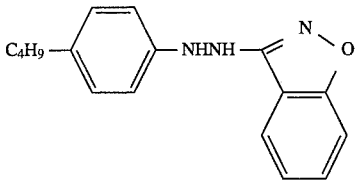
Compound II-5
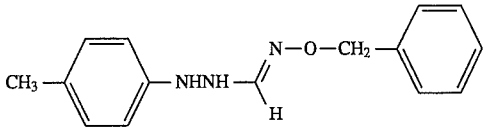
Compound II-6
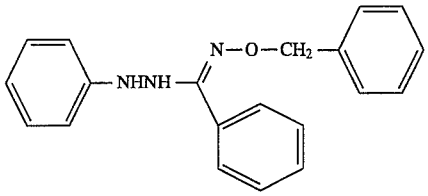
Compound II-7
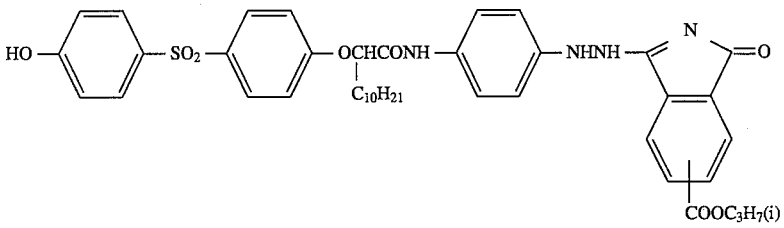
Compound II-8
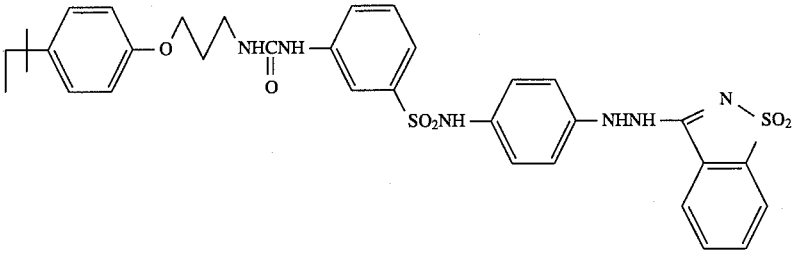

-continued
Compound II-9
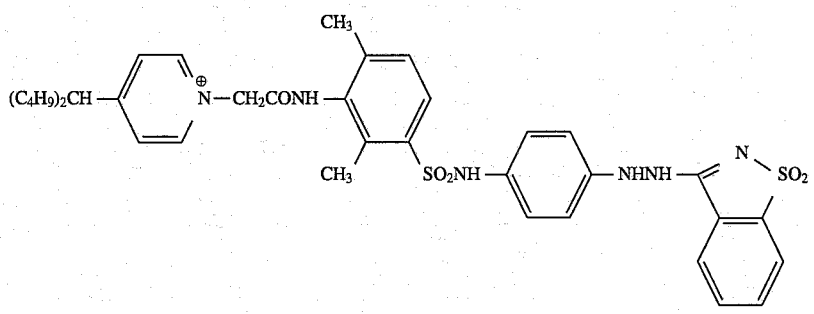
Compound II-10
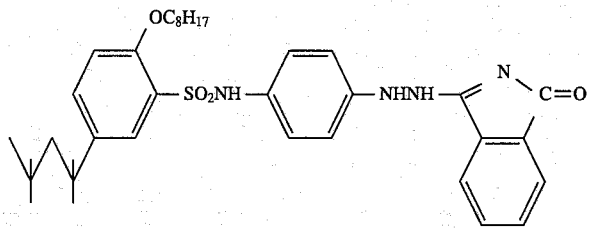
Compound II-11
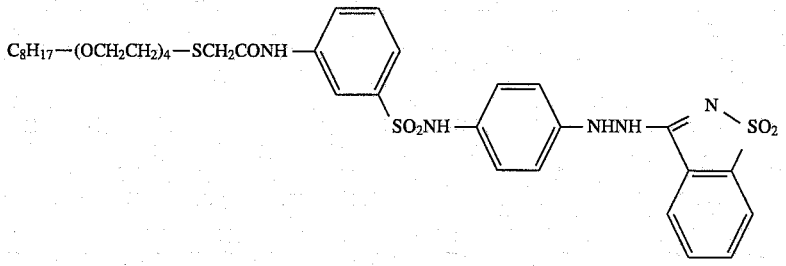
Compound II-12
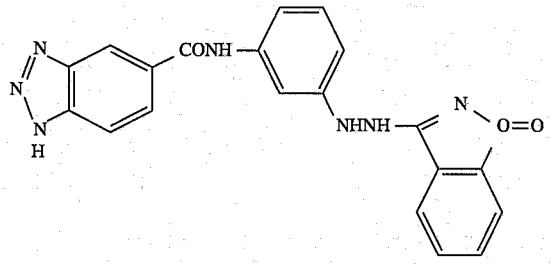
Compound II-13
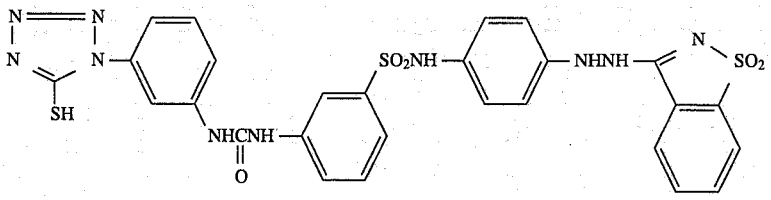
Compound II-14
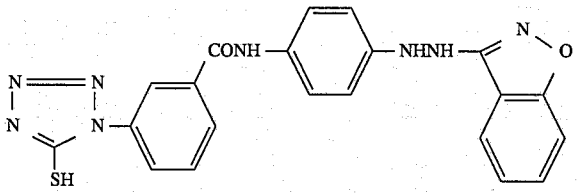

-continued

Compound II-15

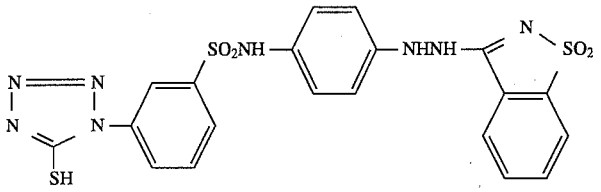

The compounds of the present invention were synthesized by reacting corresponding hydrazine with iminochloride under the presence of a base.

The representative examples will be shown below.

(Synthesis of Compound I-1)

Triethylamine (45 ml) was dropped to the mixture of a p-tolylhydrazine hydrochloric acid salt (15.9 g), a raw material compound A stated below (30.6 g) and tetrahydrofuran (200 ml) at −5° C. to 0° C. over the period of 30 minutes. Stirring was applied for 3 hours while raising a temperature to a room temperature, and then the solution was poured into water (1 liter) to obtain a crude crystal by filtering. The crude crystal thus obtained was recrystallized with a methanol- water mixed solvent to thereby obtain the compound I-1. Yield: 15 g. The chemical structure thereof was confirmed with an IR spectrum and an NMR spectrum.

Raw material compound A

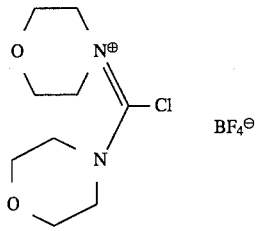

(Synthesis of Compound II-1)

Triethylamine (30 ml ) was dropped to the mixture of a p-tolylhydrazine hydrochloric acid salt (15.9 g), saccharin chloride (20.0 g) and tetrahydrofuran (200 ml ) at −5° C. to 0° C. over the period of 30 minutes. Stirring was applied for 3 hours while raising a temperature to a room temperature, and then the solution was poured into water (1 liter) to obtain a crude crystal by filtering. The crude crystal thus obtained was recrystallized with acetonitrile to thereby obtain the compound II-1. Yield: 11.5 g. The chemical structure thereof was confirmed with an IR spectrum and an NMR spectrum.

The other compounds were synthesized in the similar manners.

In incorporating the compound of the present invention into a silver halide photographic emulsion layer and a hydrophilic colloid layer, after dissolving the compound of the present invention in water or a water miscible organic solvent (alkali hydroxide and tertiary amine may be added on demand to make a salt for dissolving), the solution may be added to a hydrophilic colloid solution (for example, a silver halide emulsion, a gelatin aqueous solution, and others) (wherein acid or alkali may be added to adjust pH according to necessity).

The compound of the present invention may be used singly or in combination of two or more kinds. The addition amount of the compound of the present invention is preferably $1\times10^{-6}$ to $5\times10^{-2}$ mole, more preferably $1\times10^{-5}$ to $1\times10^{-2}$ mole per mole of silver halide, and a suitable value can be selected according to the character of a silver halide emulsion combined therewith.

To be concrete, a protective layer and an intermediate layer can be enumerated as the hydrophilic colloid layer containing the compound of the present invention.

The compound of the present invention is added preferably to a silver halide photographic emulsion layer.

The silver halide composition in the silver halide emulsion layer to which the compound of the present invention is added is not specifically limited, and there can be enumerated, for example, silver chloride, silver bromochloride, silver bromochloroiodide, silver bromoiodide, and silver bromide. Particularly in the case where a high sensitivity is required, silver bromoiodide is preferably used.

In the case where the compound of Formula (I) or (II) of the present invention is used for a hard gradation light-sensitive material for a plate making, the other various additives used for the light-sensitive material and the development processing method are not specifically limited, and those described in the following corresponding portions can be preferably applied.

| Item | | Corresponding portion |
|---|---|---|
| 1) | Nucleus forming accelerator | Formula (II-m) to (II-p) and the compound examples II-1 to II-22 at p. 9, right upper column, line 13 to p. 16, left upper column, line 10 of JP-A-2-103536; and the compounds described in JP-A-1-179939. |
| 2) | Silver halide emulsion and production process therefor | p. 20, right lower column, line 12 to p. 21, left lower column, line 14 of JP-A-2-97937; p. 7, right upper column, line 19 to p. 8, left lower column, line 12 of JP-A-2-12236; and the selenium sensitizing process described in JP-A-5-11389. |
| 3) | Spectral sensitizing dye | p. 8, left lower column, line 13 to right lower column, line 4 of JP-A-2-12236; p. 16, right lower column, line 3 to p. 17, left lower column, line 20 of JP-A-2-103536; and further the spectral sensitizing dyes described in JP-A-1-112235, JP-A-2-124560, JP-A-3-7928, and JP-A-5-11389. |
| 4) | Surface active agent | p. 9, right upper column, line 7 to right lower column, line 7 of JP-A-2-12236; and p. 2, left lower column, line 13 to p. 4, right lower column, line 18 of JP-A-2-18542. |
| 5) | Anti-fogging agent | p. 17, right lower column, line 19 to p. 18, right upper column, line 4, and right lower column, lines 1 to 5 of JP-A-2-103526; and further the thio-sulfinic acid compounds described in JP-A-1-237538. |
| 6) | Polymer latex | p. 18, left lower column, lines |

-continued

| Item | | Corresponding portion |
|---|---|---|
| | | 12 to 20 of JP-A-2-103536. |
| 7) | Compound having an acid group | p. 18, right lower column, line 6 to p. 19, left upper column, line 1 of JP-A-2-103536. |
| 8) | Matting agent, sliding agent and plasticizer | p. 19, left upper column, line 15 to right upper column, line 15 of JP-A-2-103536. |
| 9) | Hardener | p. 18, right upper column, lines 5 to 17 of JP-A-2-103536. |
| 10) | Dye | dyes described at p. 17, right lower column, lines 1 to 18 of JP-A-2-103536; and solid dyes described in JP-A-2-294638 and JP-A-5-11382. |
| 11) | Binder | p. 3, right lower column, lines 1 to 20 of JP-A-2-18542. |
| 12) | Anti-black pepper agent | the compounds described in U.S. Pat. No. 4,956,257, and JP-A-1-118832. |
| 13) | Redox compound | the compounds represented by Formula (I) (particularly the compound examples 1 to 50) in JP-A-2-301743; Formulas (R-1), (R-2) and (R-3) and the compound examples 1 to 75 described at p. 3 to 20 of JP-A-3-174143; and further the compounds described in JP-A-4-278939. |
| 14) | Monomethine compound | the compounds of Formula (II) (particularly the compound examples II-1 to II-26) described in JP-A-2-287532. |
| 15) | Dihydroxybenzenes | p. 11, left upper column to p. 12 left lower column of JP-A-3-39948; and the compounds described in EP 452772A. |
| 16) | Developing solution and developing process | p. 19, right upper column, line 16 to p. 21, left upper column, line 8 of JP-A-2-103536. |

In the case where the compound of Formula (I) or (II) of the present invention is used as a fogging agent for a light-sensitive material according to a diffusion transfer process, the other additives for the light-sensitive material are not specifically limited, and the following described portions in, for example, JP-A-4-63343 can be referred.

| | | |
|---|---|---|
| 1) | Dye image-forming: material | page 16, right upper column, line 17 to page 18, right lower column, line 16. |
| 2) | Silver halide: emulsion | page 18, right lower column, line 17 to page 19, left upper column, line 19. |
| 3) | Spectral sensitizing: dye | page 19, left lower column, lines 1 to 16. |
| 4) | Structure of a light-: sensitive element | page 19, left lower column, line 17 to page 20, right upper column, line 4. |
| 5) | Processing: composition | page 20, right upper column, line 5 to page 21, left upper column, line 8. |
| 6) | Layer structure and: others | page 21, left upper column, line 9 to page 22, right upper column, line 20, and page 12, right upper column, line 18 to page 16, line 16. |

Meanwhile, in the case where the compound of Formula (I) or (II) of the present invention is used for an autopositive color light-sensitive material, the various additives for the light-sensitive material are not specifically limited, and the following described portions in, for example, JP-A-4-34546 can be referred.

| | | |
|---|---|---|
| 1) | Internal latent: image type emulsion | page 4, left upper column, line 8 to page 5, right lower column, line 9. |
| 2) | Color coupler: | page 16, left upper column, line 1 to left lower column, line 19. |
| 3) | Others: | page 16, right lower column, line 5 to page 18, left upper column, line 9. |

BEST MODE FOR CARRYING OUT THE INVENTION

The present invention will further be explained below with the reference to the examples.

EXAMPLE 1

A silver nitrate aqueous solution and the aqueous solution of potassium iodide and potassium bromide were simultaneously added to a gelatin aqueous solution maintained at 50° C. for 60 minutes under the presence of potassium hexachloroiridate (III) of $4\times10^{-7}$ mole per mole of silver and ammonia, and pAg was maintained at 7.8 during that time, whereby the cubic monodispersed emulsion having the average grain size of 0.28 μm and the average silver iodide content of 0.3 mole% was prepared. This emulsion was desalted by a flocculation process and then inactive gelatin of 40 g per mole of silver was added. Thereafter, while maintaining at 50° C., there were added 5,5'-dichloro-9-ethyl-3,3'-bis-(3-sulfopropyl)oxacarbocyanine as a sensitizing dye, and a KI solution of $10^{-3}$ mole per mole of silver. The emulsion was aged for 15 minutes and then the temperature was lowered. This emulsion was dissolved once again, and there were added at 40° C., 0.02 mole/silver of methyl-hydroquinoe and the hydrazine derivative of the present invention or a comparison shown in Table-A. Further added were 5-methylbenzotriazole, 4-hydroxy-1,3,3*a*,7-tetrazaindene, the following development accelerators (a) and (b), 0.4 g/m$^2$ of the dispersion of polyethyl acrylate, and the mixture of the following compounds (c), (d) and (e) as a gelatin hardener. The solution was coated on a polyethylene terephthalate support (150 μm) having a waterproofing subbing layer (0.5 μm) so that the silver amount became 3.4 g/m$^2$.

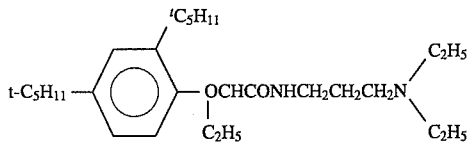

(a)

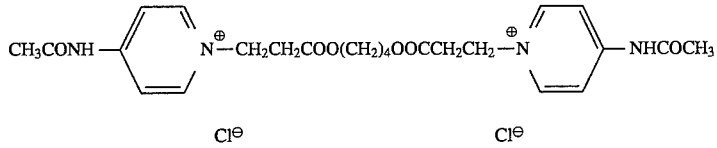

(b)

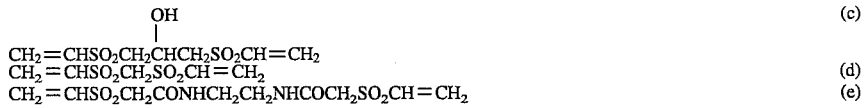

(c)

(d)

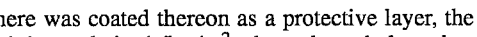

(e)

There was coated thereon as a protective layer, the layer containing gelatin 1.5 g/m$^2$, the polymethyl methacrylate particles as a matting agent (average particle size: 2.5 μm) 0.3 g/m$^2$, and the following surface active agents.

Surface active agents

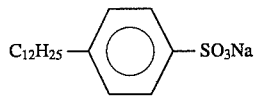

37 mg/m$^2$

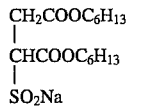

37 mg/m$^2$

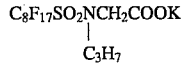

2.5 mg/m$^2$

[1] Evaluation of a hard gradation performance:

These samples were exposed to a tungsten light of 3200° K. through an optical wedge and then developed in the following developing solution-1 at 34° C. for 30 seconds, followed by fixing, washing and drying. The photographic performances of the sensitivity and gradation obtained are shown in Table-A.

The use of the nucleus forming agent of the present invention provided a high sensitivity and a high hard gradation performance.

| [Developing solution-1] | |
|---|---|
| Hydroquinone | 50.0 g |
| N-methyl-p-aminophenol | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-butyl diethanolamine | 15.0 g |
| Sodium toluenesulfonate | 8.0 g |
| Water was added to | 1 liter |
| pH was adjusted to (adding potassium hydroxide) | 11.6 |

[2] Photographic performance evaluation in a fatigued developing solution:

The above developing solution-1 was charged in the automatic developing machine for a plate making FG660F type (manufactured by Fuji Photo Film Co., Ltd.), and a development was carried out under the following three conditions at 34° C. for 30 seconds, followed by carrying out fixing, washing and drying.

[A] After the temperature of the developing solution charged in the automatic developing machine reaches 34° C., a development processing is immediately carried out (the development by a fresh solution).

[B] The development processing is carried out in the developing solution which is left for standing for 4 days as it is charged in the automatic developing machine (the development by an air-fatigued solution).

[C] After the developing solution is charged in the automatic developing machine, the Fuji Film GRANDEX GA-100 film with the size of 50.8 cm×61.0 cm is exposed so that the area of 50% thereof is developed, and it is subjected to the development processing in the solution obtained by processing 200 sheets per day repeatedly for 5 days. The developing solution-1 is replenished by 100 ml per sheet of the processed sheet number (the development by a large processing-fatigued solution).

The photographic performances thus obtained are shown in Table-A.

The photographic performances obtained in [B] and [C] desirably have no difference from the photographic performances in [A] in terms of a processing running stability.

As can be found from the results in Table-A, the use of the nucleus forming agent of the present invention provides less fluctuation of a photographic sensitivity even if the developing solution is fatigued.

TABLE-A

| Sample No. | Nucleus forming agent: Kind | Nucleus forming agent: Added amount (mol/mol Ag) | Photographic characteristic by fresh solution: Sensitivity (S)* | Photographic characteristic by fresh solution: Gradation (G)** | Photographic performance fluctuation by fatigued solution: Air-fatigued solution ($\Delta S_{B-A}$)*** | Photographic performance fluctuation by fatigued solution: Large processing-fatigued solution ($\Delta S_{C-A}$)**** |
|---|---|---|---|---|---|---|
| 1 Comp.-1 | Blank | — | 0 | 2.6 | — | — |
| 2 Comp.-2 | Comp. Compound-A | $2.5 \times 10^{-4}$ | +0.45 | 12.3 | +0.23 | −0.20 |
| 3 Invent.-1 | Compound I-2 | " | +0.48 | 15.4 | +0.10 | −0.09 |
| 4 Invent.-2 | Compound I-3 | " | +0.51 | 12.8 | +0.09 | −0.07 |
| 5 Invent.-3 | Compound I-4 | " | +0.44 | 13.2 | +0.12 | −0.07 |
| 6 Invent.-4 | Compound I-5 | " | +0.56 | 15.7 | +0.10 | −0.10 |
| 7 Invent.-5 | Compound I-6 | " | +0.51 | 14.7 | +0.08 | −0.07 |
| 8 Invent.-6 | Compound I-7 | " | +0.70 | 13.6 | +0.09 | −0.08 |
| 9 Invent.-7 | Compound I-8 | $5.0 \times 10^{-5}$ | +0.63 | 17.3 | +0.10 | −0.09 |
| 11 Comp.-11 | Blank | — | 0 | 2.6 | — | — |
| 12 Comp.-12 | Comp. Compound-A | $2.5 \times 10^{-4}$ | +0.45 | 12.3 | +0.23 | −0.20 |
| 13 Invent.-11 | Compound II-2 | " | +0.65 | 13.6 | +0.13 | −0.07 |
| 14 Invent.-12 | Compound II-7 | " | +0.59 | 14.7 | +0.12 | −0.10 |
| 15 Invent.-13 | Compound II-8 | " | +0.55 | 15.4 | +0.09 | −0.08 |
| 16 Invent.-14 | Compound II-9 | " | +0.51 | 15.9 | +0.10 | −0.07 |
| 17 Invent.-15 | Compound II-10 | " | +0.46 | 13.8 | +0.11 | −0.09 |
| 18 Invent.-16 | Compound II-11 | " | +0.56 | 18.7 | +0.09 | −0.08 |
| 19 Invent.-17 | Compound II-13 | $5.0 \times 10^{-5}$ | +0.48 | 17.4 | +0.08 | −0.07 |

[Comparative compound-A]

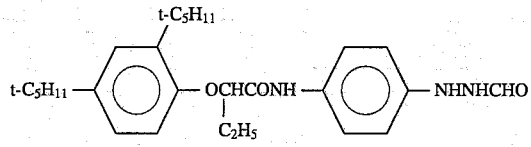

| | |
|---|---|
| *Sensitivity: | based on the sensitivity (log E) of a blank, which is set as a standard, the sensitivity is shown by the difference therefrom. Accordingly, the difference of, for example, −0.1 shows that the sensitivity is lower by 0.1 as compared with the blank in terms of log E, that is, the sensitivity is lower by 10 times. |
| **Gradation (G): | the gradation is the gradient of a straight line obtained by connecting the point of 0.3 and the point of 3.0 in the characteristic curve. A larger value shows a harder gradation. |
| ***$\Delta S_{B-A}$: | the difference between the sensitivity ($S_B$) obtained when the development is carried out in an air-fatigued solution and the sensitivity ($S_A$) obtained when the development is carried out in a fresh solution. |
| ***$\Delta S_{C-A}$: | the difference between the sensitivity ($S_C$) obtained when the development is carried out in a large processing-fatigued solution and the sensitivity ($S_A$) obtained when the development is carried out in the fresh solution. |

EXAMPLE 2

After a silver nitrate aqueous solution and a sodium chloride aqueous solution were simultaneously added to a gelatin aqueous solution maintained at 50° C. under the presence of $(NH_4)_3RhCl_6$ of $5.0\times10^{-6}$ mole per mole of silver, and then soluble salts were removed by the method known well in the art, gelatin was added, and then 2-methyl-4-hydroxy-1,3,3*a*, 7-tetrazaindene was added as a stabilizer without providing a chemical sensitization. This emulsion was the monodispersed emulsion with a cubic crystal form having the average grain size of 0.15 μm.

The hydrazine compound was added to this emulsion as shown in Table-B, and there were added a polyethyl acrylate latex of 30 wt% as a solid matter based on gelatin, and three kinds of the compounds used in Example 1 (that is, the mixture of the compounds (c), (d) and (e)) as a hardener. The solution was coated on a polyester support so that an Ag amount became 3.8 g/m$^2$; Gelatin was 18 g/m$^2$. There was coated thereon as a protective layer, the layer containing gelatin 1.5 g/m$^2$, the polymethyl methacrylate particles (average particle size: 2.5 μm) 0.3 g/m$^2$ as a matting agent, further the following surface active agents as a coating aid, a stabilizer, and a UV absorbing dye, followed by drying.

Surface active agents

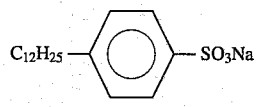

37 mg/m$^2$ $CH_2COOC_6H_{13}$
|
$CHCOOC_6H_{13}$ 37 mg/m$^2$
|
$SO_2Na$ $C_8F_{17}SO_2NCH_2COOK$ 2.5 mg/m$^2$
|
$C_3H_7$

Stabilizer

Thioctic acid 2.1 mg/m$^2$

-continued

UV absorbing dye

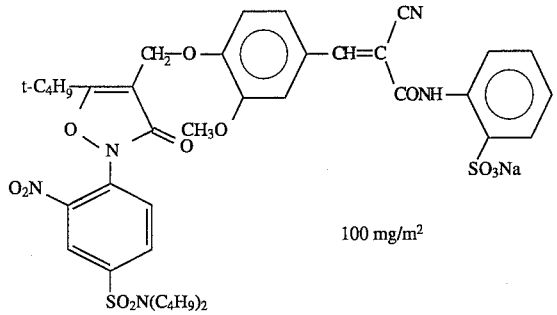

100 mg/m²

This sample was subjected to an exposure with the daylight printer P-607 manufactured by Dainippon Screen Co., Ltd. through an optical wedge and then to a development processing at 38° C. for 20 seconds, followed by fixing, washing and drying.

The results of the photographic performances are shown in Table-B.

It can be found from the results of Table-B that a high hard gradation can be obtained in the samples of the present invention as compared with the samples of a comparative example.

Further, the photographic performances tested in the fatigued developing solution similarly to Example 1 resulted in showing the preferred result that the samples of the present invention had a small fluctuation as shown in Table-B.

TABLE-B

| Sample No. | Nucleus forming agent: Kind | Nucleus forming agent: Added amount (mol/mol Ag) | Photographic characteristic by fresh solution: Sensitivity (S)* | Photographic characteristic by fresh solution: Gradation (G)** | Photographic performance fluctuation by fatigued solution: Air-fatigued solution ($\Delta S_{B-A}$)*** | Photographic performance fluctuation by fatigued solution: Large processing-fatigued solution ($\Delta S_{C-A}$)**** |
|---|---|---|---|---|---|---|
| 1 Comp.-1 | Blank | — | 0 | 4.8 | — | — |
| 2 Comp.-2 | Comp. Compound-A | $1.5 \times 10^{-3}$ | +0.16 | 9.2 | +0.11 | −0.09 |
| 3 Invent.-1 | Compound I-2 | " | +0.17 | 12.3 | +0.07 | −0.06 |
| 4 Invent.-2 | Compound I-3 | " | +0.19 | 11.3 | +0.08 | −0.06 |
| 5 Invent.-3 | Compound I-4 | " | +0.21 | 13.1 | +0.06 | −0.07 |
| 6 Invent.-4 | Compound I-5 | " | +0.20 | 17.1 | +0.05 | −0.05 |
| 7 Invent.-5 | Compound I-7 | " | +0.17 | 16.3 | +0.06 | −0.07 |
| 8 Invent.-6 | Compound I-8 | " | +0.24 | 14.2 | +0.05 | −0.05 |
| 9 Invent.-7 | Compound I-12 | $3.0 \times 10^{-4}$ | +0.25 | 12.8 | +0.03 | −0.05 |
| 11 Comp.-11 | Blank | — | 0 | 4.8 | — | — |
| 12 Comp.-12 | Comp. Compound-A | $1.5 \times 10^{-3}$ | +0.16 | 9.2 | +0.11 | −0.09 |
| 13 Invent.-11 | Compound II-2 | " | +0.19 | 13.8 | +0.04 | −0.05 |
| 14 Invent.-12 | Compound II-7 | " | +0.22 | 14.3 | +0.06 | −0.06 |
| 15 Invent.-13 | Compound II-8 | " | +0.20 | 15.2 | +0.05 | −0.05 |
| 16 Invent.-14 | Compound II-9 | " | +0.18 | 13.6 | +0.05 | −0.04 |
| 17 Invent.-15 | Compound II-10 | " | +0.22 | 12.8 | +0.06 | −0.05 |
| 18 Invent.-16 | Compound II-11 | " | +0.21 | 13.9 | +0.05 | −0.03 |
| 19 Invent.-17 | Compound II-13 | $3.0 \times 10^{-4}$ | +0.22 | 17.1 | +0.07 | −0.04 |

POSSIBILITY OF UTILIZING IN INDUSTRY

The use of the compound of the present invention of Formula (I) or (II) for a hard gradation light-sensitive material for a plate making provides a negative image having a ultrahard gradation and an excellent dot image quality at a high sensitivity.

The use of the compound of the present invention of Formula (I) or (II) as a fogging agent for a silver halide emulsion for a light-sensitive material by a diffusion transfer process provides a silver halide photographic light-sensitive material in which an emulsion has an excellent aging stability and an activity fluctuation in manufacturing the light-sensitive material is small.

Further, the use of the compound of the present invention of Formula (I) or (II) for an autopositive type color light-sensitive material provides a direct positive image having an excellent reversal characteristic even in a stable developing solution.

I claim:

1. A silver halide photographic material comprising at least one silver halide photographic emulsion layer, wherein said photographic emulsion layer or another hydrophilic colloid layer contains at least one of the compounds represented by Formula (I) or (II):

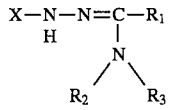

Formula (I)

wherein X represents an aliphatic group, an aromatic group, or a heterocyclic group; $R_1$ represents a hydrogen atom, an alkyl group, an aryl group, an alkoxy group, an aryloxy group, or an amino group; $R_2$ and $R_3$ each represent an aliphatic group, an aromatic group, or a heterocyclic group and may be the same or different; and further $R_1$, $R_2$, and $R_3$ may be combined with each other to form a ring;

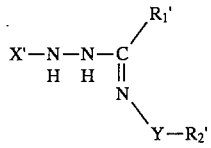

Formula (II)

wherein X' represents an aliphatic group, an aromatic group, or a heterocyclic group; Y represents a —O— group, a —$NR_3$'— group, a—S— group, a —SO— group, a —$SO_2$— group or a —CO— group; $R_1$', and $R_3$' each represent a hydrogen atom an aliphatic group, an aromatic group, or a heterocyclic group and may be the same or different; $R_2$' represents an aliphatic group, an aromatic group, or a heterocyclic group; and further $R_1$', $R_2$', and $R_3$ may be combined with each other to form a ring, and in the case where $R_1$'and $R_2$' are combined to form a ring, either one of them may be a single bond.

2. The silver halide photographic material of claim 1 wherein X of formula (I) is substituted with a substituent selected from the group consisting of an alkyl group, an aralkyl group, an alkenyl group, an alkynyl group, an alkoxy group, an aryl group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an aryloxycarbonyl group, an acyl group, an alkoxycarbonyl group, an acyloxy group, a carbonamide group, a sulfonamide group, a nitro group, and a group represented by Formula (A) having the following formula:

$$R_4-L-Z-\underset{\underset{R_5}{|}}{N}- \qquad \text{Formula (A)}$$

wherein Z represents —CO—, —$SO_2$— or —P(=O)($R_6$)—; $R_6$ represents an alkoxy group or an aryloxy group; L represents a single bond, —O—, —S—, or —$NR_7$— $R_7$ represents a hydrogen atom, an aliphatic group, or an aromatic group; $R_4$ and $R_5$ each represent a hydrogen atom, an aliphatic group, an aromatic group, or a heterocyclic group and may be the same or different, or $R_4$ and $R_5$ may be combined with each other to form a ring.

3. The silver halide photographic material of claim 1, wherein X of formula (I) is unsubstituted.

4. The silver halide photographic material of claim 1 wherein $R_1$ of formula (I) is substituted by a substituent selected from the group consisting of an alkyl group, an aralkyl group, an alkenyl group, an alkynyl group, an alkoxy group, an aryl group, an acylamino group, a sulfonylamino group, a ureido group, a urethane group, a sulfamoyl group, a carbamoyl group, a sulfonyl group, a sulfinyl group, a hydroxy group, a halogen atom, a cyano group, a sulfo group, a carboxyl group, aryloxycarbonyl group, an acyl group, an alkoxycarbonyl group, an acyloxy group, a carbonamide group, a sulfonamide group, a nitro group, an alkylthio group, and an arylthio group.

5. The silver halide photographic material of claim 1, wherein $R_1$ of formula (I) is unsubstituted.

6. The silver halide photographic material of claim 1 wherein $R_2$ and $R_3$ of formula (I) are each substituted by a substituent selected from the group consisting of an alkyl group, an aralkyl group, an alkenyl group, an alkynyl group, an alkoxy group, an aryl group, an acylamino group, a sulfonylamino group, a ureido group, a urethane group, a sulfamoyl group, a carbamoyl group, a sulfonyl group, a sulfinyl group, a hydroxy group, a halogen atom, a cyano group, a sulfo group, a carboxyl group, an aryloxycarbonyl group, an acyl group, an alkoxycarbonyl group, an acyloxy group, a carbonamide group, a sulfonamide group, a nitro group, an alkylthio group, and an arylthio group.

7. The silver halide photographic material of claim 1, wherein $R_2$ and $R_3$ of formula (I) are each unsubstituted.

8. The silver halide photographic material of claim 1 wherein X' of formula (II) is substituted with a substituent selected from the group consisting of an alkyl group, an aralkyl group, an alkenyl group, an alkynyl group, an alkoxy group, an aryl group, an aryloxy group, a sulfamoyl group, a carbamoyl group, an alkylthio group, an arylthio group, a halogen atom, a cyano group, a sulfo group, a carboxyl group, an aryloxycarbonyl group, an acyl group, an alkoxycarbonyl group, an acyloxy group, a carbonamide group, a sulfonamide group, a nitro group, and a group represented by Formula (B) having the following formula $$R_4-L-Z-\underset{\underset{R_5}{|}}{N}- \qquad \text{Formula (B)}$$

wherein Z represents —CO—, —$SO_2$—, or —P(=O)($R_6$)—; $R_6$ represents an alkoxy group or an aryloxy group; L represents a single bond, —O—, —S—, or —$NR_7$—; $R_7$ represents a hydrogen atom, an aliphatic group, or an aromatic group; and $R_4$ and $R_5$ each represent a hydrogen atom, an aliphatic group, an aromatic group, or a heterocyclic group and may be the same or different, or $R_4$ and $R_5$ may be combined with each other to form a ring.

9. The silver halide photographic material of claim 1 wherein X' of formula (II) is unsubstituted.

10. The silver halide photographic material of claim 1 wherein $R_1$' and $R_2$' of formula (II) are each substituted with a substituent selected from the group consisting of an alkyl group, an aralkyl group, an alkenyl group, an alkynyl group, an alkoxy group, an aryl group, an acylamino group, a sulfonylamino group, a ureido group, a urethane group, an aryloxy group, a sulfamoyl group, a carbamoyl group, a sulfinyl group, a hydroxy group, a halogen atom, a cyano group, a sulfo group, a carboxyl group, an aryloxycarbonyl group, an acyl group, an alkoxycarbonyl group, an acyloxy group, a carbonamide group, a sulfonamide group, a nitro group, an alkylthio group, and an arylthio group.

11. The silver halide photographic material of claim 1, wherein $R_1$' and $R_2$' of formula (II) are each unsubstituted.

* * * * *